United States Patent [19]

Schubert et al.

[11] Patent Number: 4,813,263

[45] Date of Patent: Mar. 21, 1989

[54] FORGING MACHINE

[75] Inventors: Hans A. Schubert, Dusseldorf; Klaus Schulze, Monchen-Gladbach, both of Fed. Rep. of Germany

[73] Assignee: SMS Hasenclever Maschinenfabrik GmbH, Dusseldorf, Fed. Rep. of Germany

[21] Appl. No.: 96,998

[22] Filed: Sep. 16, 1987

[30] Foreign Application Priority Data

Sep. 16, 1986 [DE] Fed. Rep. of Germany ..... 3631439

[51] Int. Cl.[4] ..... B21J 7/02

[52] U.S. Cl. ..... 72/402; 72/447

[58] Field of Search ..... 72/402, 407, 399, 447, 72/76, 413; 100/264, 226

[56] References Cited

U.S. PATENT DOCUMENTS 3,656,334 4/1972 Schenk et al. ..... 72/399
3,657,916 4/1972 Pahnke ..... 72/447
3,929,000 12/1975 Kralowetz ..... 72/402

FOREIGN PATENT DOCUMENTS 555710 2/1960 Belgium ..... 72/402

*Primary Examiner*—Daniel C. Crane
*Attorney, Agent, or Firm*—Holman & Stern, Chartered

[57] ABSTRACT

A forging machine having rams arranged in the form of a cross carry respective tools adjustable transversely to the ram axes and partly overlapping one another, so that a closed pass can be formed for any size of the forging pass. To adjust the tools transversely, each tool is carried on a respective crosspiece which can be clamped against the ram end or can be released and moved transversely on the ram. The clamping and releasing and the adjustment movement are all effected by a rotary tie rod extending through the crosspiece and through the ram, having one end coupled to the crosspiece for clamping it and moving it transversely to the ram, and the other end coupled to a clamping mechanism and to a rotary adjustment drive.

15 Claims, 5 Drawing Sheets

FORGING MACHINE

BACKGROUND OF THE INVENTION

1. Field of the Invention

The invention relates to a forging machine of the type known as a radial forming machine, having four rams which are disposed in a cruciform manner in a single operating plane and are movable radially to the longitudinal axis of the workpiece and are provided with tools.

2. Description of the Prior Art

It is known to design forging machines of the cruciform type mentioned above.

BRIEF SUMMARY OF THE INVENTION

In the order that the tools may form a closed pass in the inner end positions of the stroke of the rams, the tools are connected to the rams by crosspieces which are adjustable transversely to the rams in the operating plane and which with the rams form a support, the adjustment being effected, as a function of the setting of the ram stroke end position, by an amount such that each tool is covered, on the unused width of its operative surface, by a lateral surface of an adjacent tool, and itself covers with its lateral surface the unused width of the operative surface of the other adjacent tool. In order to keep the time for adjusting the tools to a minimum, the crosspieces are connected to the rams by releasable clamping devices which produce a mutual biassing of the crosspiece and ram by the force of a spring and release the clamping device by a piston-cylinder unit acting against the spring force. The clamping devices require a considerable outlay in production, and their location in the vicinity of the tools and the workpiece with its heat radiation is disadvantageous, while the crosspiece is adjusted relative to the ram by way of a shaft which connects the drive, arranged at the end of the ram remote from the crosspiece on account of the considerable space required, of the adjustment device to the crosspiece on the end face of the ram and passes through an axial bore in the ram.

An object of the invention is to provide a clamping and adjustment device between the crosspiece and its ram, which is less expensive structurally and is remote from the region of direct heat radiation.

According to the invention, each ram and the crosspiece associated therewith are traversed by a tie rod which is provided with collars and which with the collars embraces the crosspiece, the ram and a tensioned spring disposed below the collar at the free end of the ram when the crosspiece is tensioned against the ram, a piston, which can be biased against the spring force in a cylinder connected to the ram and which then releases the tensioning of the crosspiece against the ram, bears against the collar under which the spring is disposed, and the tie rod is extended beyond the collar under which the spring is disposed and is connected rotationally rigidly but axially displaceably to a rotary drive supported on the machine frame by way of the cross member for adjusting the stroke position.

Because according to the invention, the shaft passing through the ram serves also as a tie rod, the spring and the countervailing piston-cylinder unit which form the clamping device can be relocated at the end of the ram remote from the tool and crosspiece, i.e. in the area which is remote from the heat radiation and which is less restricted in terms of space.

According to a further feature of the invention, the tie rod collar associated with the crosspiece, is constructed as a lever arm which is provided with a pin parallel to the tie rod and a slide block mounted pivotably on the pin, the crosspiece being provided with a slotted guide which extends transversely to its direction of displacement and into which the slide block engages. In this design, the crosspiece with the slotted guide, the lever with the slide block and the tie rod are particularly suitable for transmitting high clamping and displacement forces.

The surface of the crosspiece, which is provided only with a collar of the tie rod and which is covered in a protective manner by a cover supporting the tool, also permits an easy-to-manufacture, robust design of the connexion of the crosspiece to the ram, in that the crosspiece is guided relative to the ram by guide blocks which in one part (ram or crosspiece) lie in grooves and in the other part are guided in grooves providing space for the adjustment of the crosspiece. In order to produce positive locking between the ram and the crosspiece, inter-locking members are provided which lie in recesses in the ram and the crosspiece respectively and are provided on mutually opposite faces, with fine teeth which mesh with one another when the crosspiece is clamped against the ram.

In order to permit the spring associated with the outer collar of the tie rod to be accommodated in a structurally advantageous manner and to be mounted simply, according to a further feature of the invention a spring cup is provided which can be connected to the ram and in which the spring or set of springs is disposed between spring plates and axial bearings supporting the latter, a cover of the spring cup being constructed as an annular cylinder in which is guided an annular piston which is operatively connected to the axial bearing of the spring plate connected to the collar of the tie rod. The arrangement of the axial bearings permits the tie rod to turn for the lateral adjustment of the crosspiece with respect to the ram, as soon as the spring or set of springs is compressed by biasing the piston, whereby the crosspiece is pushed away from the ram and the fine teeth of the inter-locking members are disengaged.

To enable the tie rod to be used in a simple manner for the transverse displacement of the crosspiece with respect to the ram, according to a further feature of the invention the outer end of the tie rod, projecting from the ram, is provided with a multiply splined pin with which it engages in a multiply splined hub which is connected to a rotary drive by way of a coupling which compensates for radial displacement. In particular, a gearwheel moved by two opposed plunger pistons by way of toothed racks is provided as the rotary drive.

Rams of different design are possible within the scope of the invention.

Thus, according to one embodiment of the invention, a cylinder guided axially movably in the machine frame and provided with a central shaft is provided as a ram, the annular piston, which is associated with the cylinder and which surrounds the shaft, being supported by way of a cross member which is adjustable with respect to the machine frame for adjusting the stroke position.

According to one another embodiment of the invention, a piston which is guided in the bore of a cylinder connected to the machine frame and which is provided with a shaft is provided as a ram, a stopper, which surrounds the piston shaft and which closes the cylinder bore, being supported by way of a cross member which is adjustable with respect to the machine frame for adjusting the stroke position.

According to a further embodiment of the invention, a piston guided in a cylinder and provided with a shaft passing through the cylinder base is provided as the ram, the cylinder being adjustable in the machine frame for adjusting the stroke position.

Finally, according to yet another embodiment of the invention, a central shaft, which is guided in the machine frame and is provided with an annular flange on which piston-cylinder units engage, is provided as the ram, the piston-cylinder units being supported by way of a cross member which is adjustable with respect to the machine frame for adjusting the stroke position.

In each case, whether the shaft forms part of a piston or part of a cylinder, or whether it forms the ram per se, it has a through bore for receiving the tie rod. The rotary drive connected to the tie rod is advantageously mounted in a bracket to the cross member, so that with the cross member it participates in the adjustment of the stroke position, so that between the tie rod and its rotary drive only the operating stroke has to be compensated and not the total stroke, as would be necessary if the rotary drive were supported directly on the machine frame.

BRIEF DESCRIPTION OF THE DRAWINGS

The invention will now be described in detail with reference to the accompanying drawings wherein.

DETAILED DESCRIPTION

Figure 1:
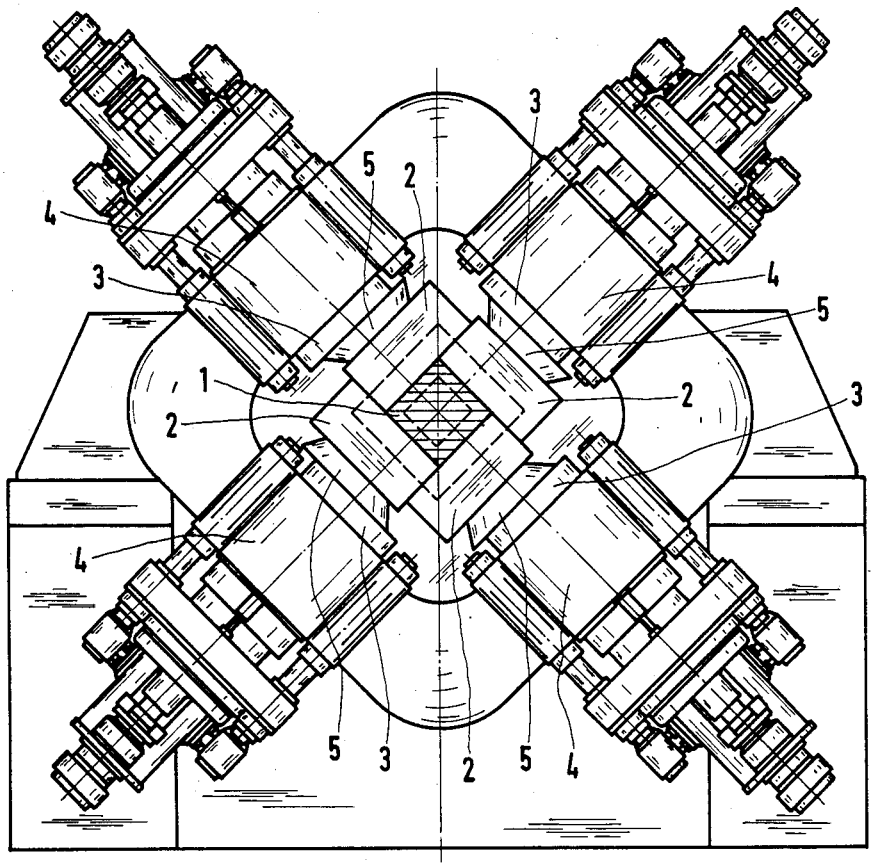
FIG. 1 is an elevational general axial view of a forging machine in accordance with the invention with the workpiece shown in cross section.
Figure 2:
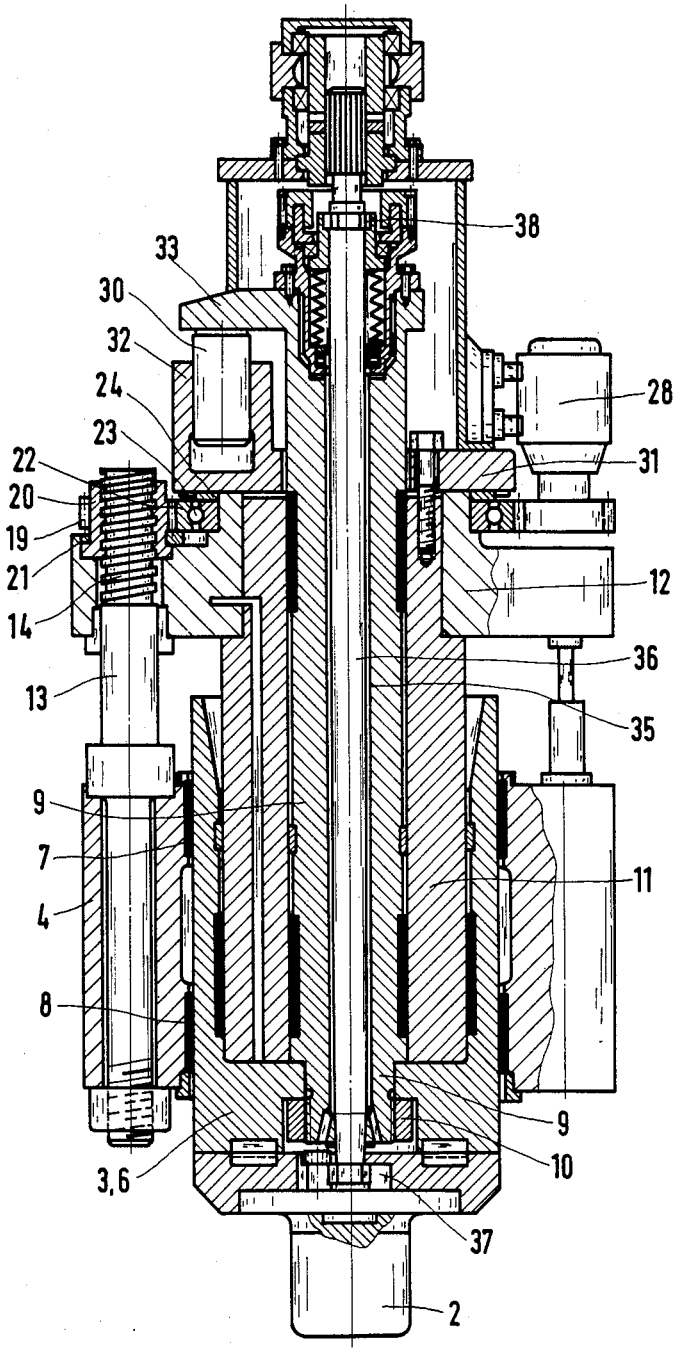
FIG. 2 is an enlarged cross-sectional view of one of the rams of the machine of FIG. 1, generally in a plane transverse to the longitudinal axis of the workpiece.
Figure 3:
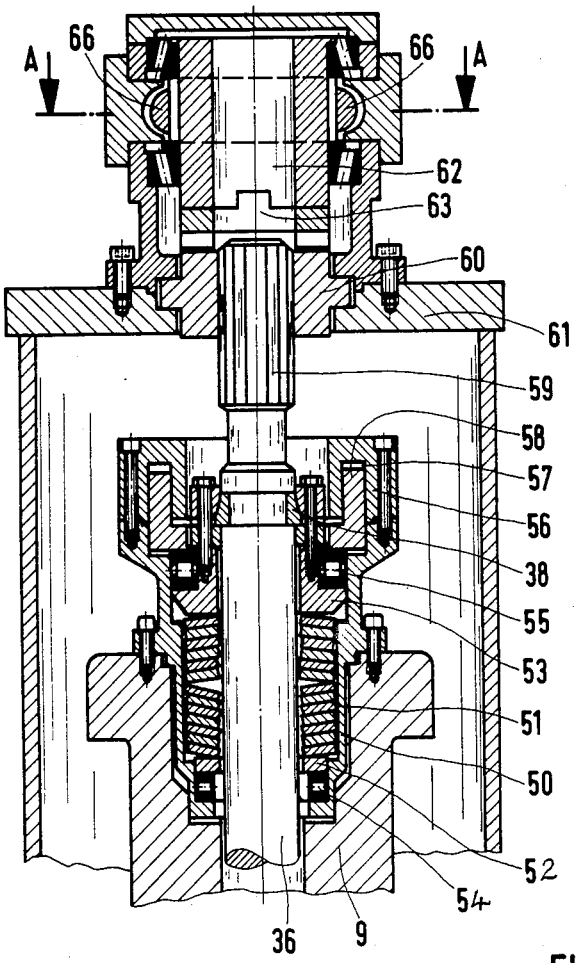
FIG. 3 is a further enlarged cross-sectional view showing details of the upper part of FIG. 2.
Figure 4:
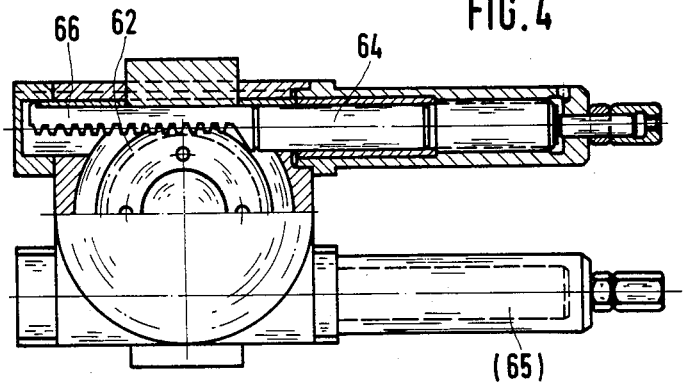
FIG. 4 is a cross-sectional view taken along line A-A in FIG. 3.
Figure 5:
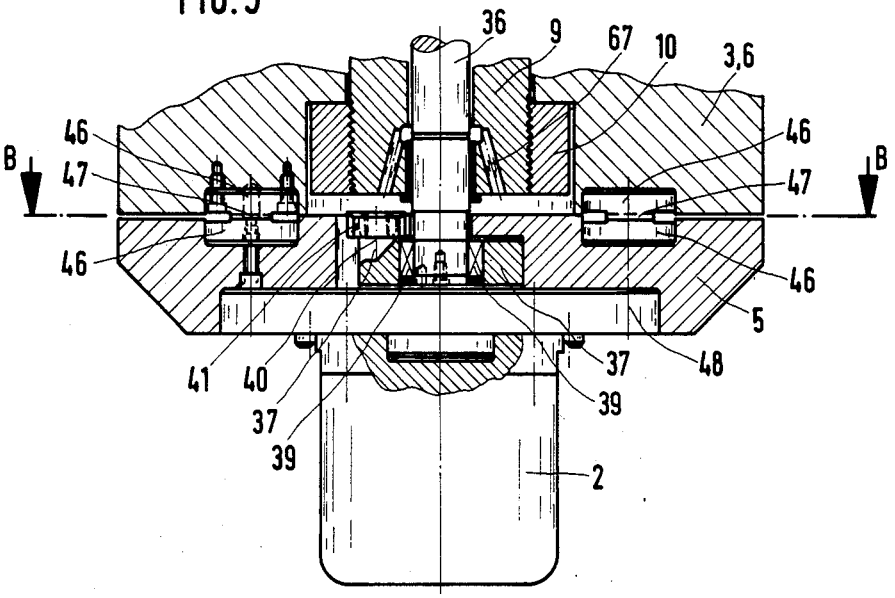
FIG. 5 is a further enlarged cross-sectional view showing details of the lower part of FIG. 2.
Figure 6:
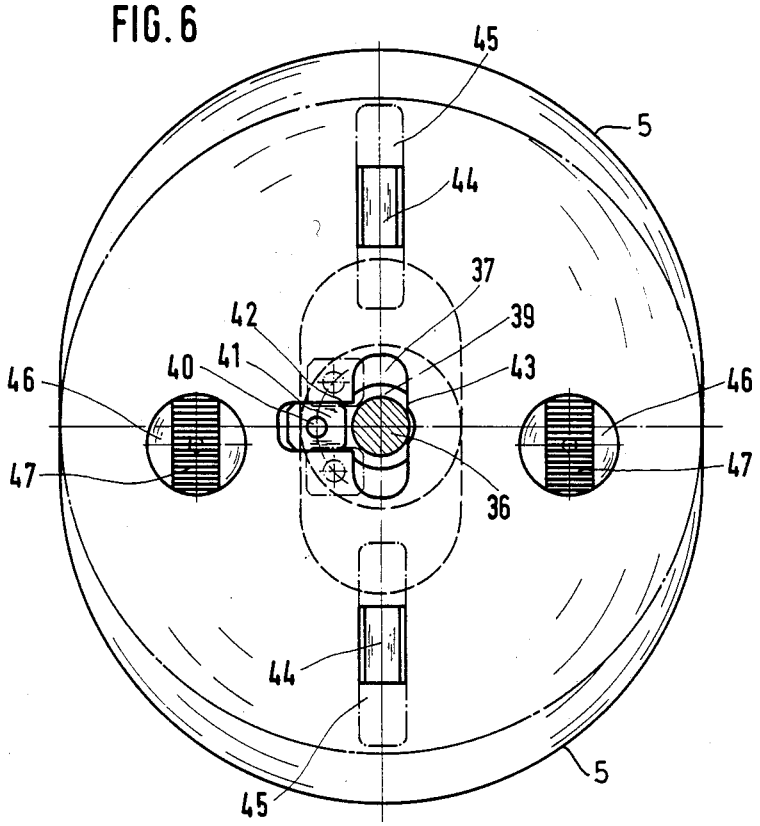
FIG. 6 is a cross-sectional view taken along section line B-B in FIG. 5.

A forging work-piece 1 to be forged is shown in cross-section in FIG. 1. The cross-sectional size is determined by the respective inner end position of the stroke of the tools relative to one another and the position of the tools 2 corresponding thereto. It can be seen that only part of the end surface of each ram is used, the unused width of the operative end surface of each tool 2 being covered in one stroke end position by the lateral surface of one adjacent tool 2. The greatest available cross-section, determined by the width of the tool, and the smallest cross-section, determined by the maximum mutual covering of the tools 2, are shown in broken lines in FIG. 1.

The tools 2 are supported and moved by rams 3, which are arranged axially movably in the machine frame 4. Four rams 3 are provided, which are arranged in a cross in a single common plane, at right angles to the longitudinal axis of the workpiece, and are moved radially to the workpiece 1. The lateral setting of the tools 2 relative to the rams 3 is carried out by means of movable crosspiece 5, which together with the rams 3 form supports, such that the crosspieces 5 can be adjusted and fixed transversely to the axes of the rams in the operating plane. The stroke end position of a tool 2, which depends on the cross-section sought, determines the lateral setting of an adjacent tool, which with its lateral surface covers the unused width of the operative surface of the first tool 2.

In the embodiment shown in FIGS. 1 to 6, each ram 3 is constructed as a cylinder 6 which is guided in the machine frame 4 in guide members 7 and 8, which can be constructed as round or flat guides, in the latter case to prevent the cylinder 6 from rotating in the machine frame 4. A shaft 9, which is secured to the cylinder 6 by a nut 10, is inserted into the cylinder base, which has a through bore. An annular piston 11, which surrounds the shaft 9, is supported on the machine frame 4 by way of a cross member 12. For this purpose, tie rods, which are extended to form spindles 13 with threaded shafts 14, are mounted into the machine frame 4. Nuts 20, which are provided with toothing 19 on the outside and with threads on the inside, are mounted rotatably in the cross members 12 and are held by split bearing plates 21. The four nuts 20 of one cross member 12 are turned jointly by a toothed ring 22 which can be rotated on balls 23 on a bearing ring 24 centered and mounted on the cross member 12. A motor 28 with a pinion is provided for driving the toothed ring 22. By turning the toothed ring 22 and thus the nuts 20, the position of the cross member 12 along the spindles 13 changes and thus the position of the annular piston 11 changes with respect to the cross member 12 and the stroke position of the associated ram 3. The operating stroke of the cylinder 6 or ram 3 respectively is limited by the stroke path of a pull-back piston 30. For this purpose a plate 31, in which are formed the cylinders 32 which receive the pull-back pistons 30, is mounted on the cross member 12, and a further cross member 33, on which the pistons 30 abut to limit the stroke path of the ram 3 and cause it to return, is connected to the shaft 9.

The shaft 9 is bored through its entire length and in its bore 35 receives a tie rod 36 which is provided with collars 37 and 38 at opposite ends. The tie rod 36 also passes through the crosspiece 5 mounted on the end face of the ram 3. The collar 37 is mounted on the inner end (relative to the workpiece) of the tie rod 36 and is connected to it by wedges 39, and bears against the crosspiece 5. The collar 37 is constructed as a lever, on which is a pin 40 and a slide block 41 is mounted on the pin 40. The pin 40 and slide block 41 engage in one arm, constructed as a slotted guide 42, of a T-shaped recess in the crosspiece 5, while the other arm, in the form of slotted guide 43 (the crosspiece of the T), forms the passage for the tie rod 36. Guide blocks 44, which guide the crosspiece 5 by engaging guide grooves 45 in it, are formed in recesses on the end face of the ram 3. Interlocking members 46, which have fine toothed racks 47 on their opposed faces, are inserted in further recesses on the end face of the ram 3 and in corresponding recesses in the crosspiece 5. The recess in the crosspiece 5, which receives the collar 37, is closed by a cover 48, which encloses the collar 37 and also acts as a support plate for the tool 2.

A spring cup 50, which accommodates a set of springs 51, is secured to the shaft 9. Spring plates 52 and 53 support the set of springs 51, by way of axial bearings 54 and 55, at one end on the base of the spring cup 50 and at the other end on the outer collar 38 of the tie rod 36. A cover 56 of the spring cup 50 is constructed with an annular cylinder 57, in which an annular piston 58 is guided. When the cylinder 57 is pressurized the tie rod 36 is displaced axially by means of the collar 38, tie rod 36, via the cover 48, pushes the crosspiece 5 away from the ram 3 so that the intermeshing toothing 47 of the locking members 46 disengages, and by turning the tie rod 36 the crosspiece 5 can be displaced transversely to the axis of the ram in the operating plane, by way of the collar 37, the pins 40 and the slide block 41.

At its outer end the tie rod 36 is extended and is formed as a multiply splined pin 59 and the latter engages in a multiply splined hub 60, which is mounted axially fixed with radial clearance in a bracket 61 mounted on the cross member 12. A gearwheel 62, which is connected rotationally rigidly to the hub 60 by way of an Oldham coupling 63, is mounted in the bracket 61. The gearwheel 62 is driven by two plungers 64 and 65 which operate in opposite directions and which are connected to toothed racks 66 which mesh with the gearwheel 62.

When annular piston 58 is pressurized, thereby displacing the rod 36 and cross piece 5, compressed air is fed by way of a supply line (no shown) into the bore 35, and emerges by way of bores 67 and the gap existing between the end face of the ram and the crosspiece 5 and prevents contamination.

The actuation of the turning apparatus, i.e. the pressurizing of the plungers 64, 65 is possible only when the annular piston 58 is also pressurized to release the crosspiece 5 from engagement with the ram by toothing 47. The displacement of the tools 2 by the plungers 64 and 65 is performed as a function of the stroke position setting of the adjacent ram 3 by the motor 28.

Figure 7:
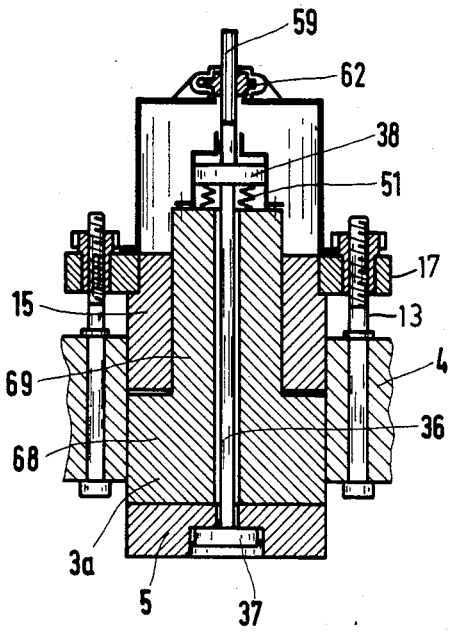
FIGS. 7, 8 and 9 are schematic reduced cross-sectional views corresponding to FIG. 2 illustrating further embodiments of the invention.
Figure 8:
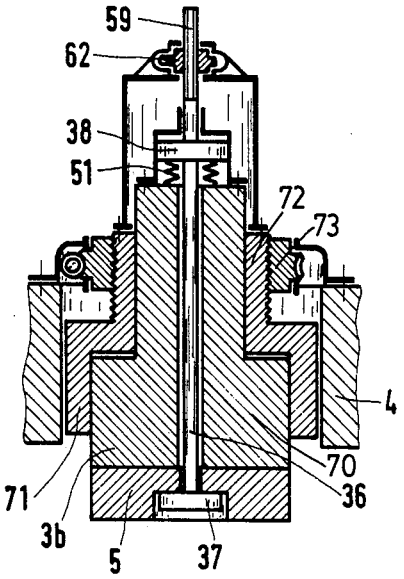
Figure 9:
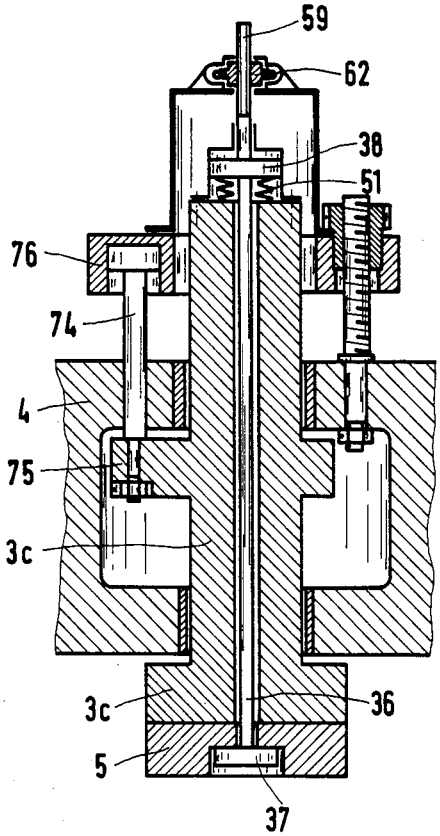

Further embodiments are shown diagrammatically in FIGS. 7, 8 and 9, the same reference numerals being used for corresponding parts.

In the embodiment illustrated in FIG. 7 the machine frame 4 is constructed as a cylinder or is rigidly connected to the cylinder. The ram 3*a* is constructed as a piston 68 and the cylinder is closed by a stopper 15, through which the shaft 69 of the piston 68 passes. The stopper 15 is connected to a cross member 17 which is displaceable along the spindles 13 for setting the stroke position.

In the embodiment illustrated in FIG. 8, the ram 3*b*, constructed as a piston 70, is guided in a cylinder 71 which is guided and adjustable in the machine frame 4, for which purpose the cylinder 71 is provided with a neck 72 which has a thread and is adjustable by a nut 73 mounted in the machine frame for setting the stroke position.

In the embodiment illustrated in FIG. 9, the ram 3*c* is guided directly in the machine frame 4. The piston-cylinder units 74 which move the ram 3*c* and which are connected to the ram 3*c* by way of an annular flange 75, are supported on the machine frame 4 by way of a cross member 76, for which purpose the cross member 76 is longitudinally adjustable by spindles 74, in order to set the stroke position.

We claim:

1. A forging machine comprising a machine frame, four rams disposed thereon radially about an axis of the machine, on which axis workpiece can be disposed, said rams being arranged in a cross in an operating plane perpedicular to said axis; a respective crosspiece supported on each ram at the inner end of the latter adjacent the said machine axis; a respective forging tool supported on each said crosspiece, operative faces on said tools which faces together form a forging pass which is closed when the rams are at predetermined inner end positions of their ram strokes, side faces on said tools so disposed that at said inner end positions each tool has a side face which covers that part of the operative face of one of the adjacent tools that is not exposed in said closed forging pass and similarly part of its own operative face is covered by a side face of the other adjacent tool; each said crosspiece being adjustable on the associated ram in said operating plane transversely to the axis of the ram whereby the size of said covered parts of said operative surfaces of the tools can be adjusted to correspond to a required size of the forging pass; a respective tie rod extending longitudinally slidably through and rotatable in each ram and extending into the respective crosspiece associated therewith; lateral abutment means on said tie rod for clamping said crosspiece against said ram on axial outward movement of said tie rod; means, remote from said crosspiece, for effecting bidirectional axial movement of the tie rod for thereby selectively clamping said crosspiece to said ram by said abutment means and releasing said clamping; transmission means coupling said tie rod to said cross piece for converting rotation of the tie rod into adjustment motion of said crosspiece transversely to the associated ram axis; and rotary adjustment drive means coupled to the tie rod remotely from said crosspiece for rotating said tie rod.

2. The forging machine of claim 1 in which said means for effecting bidirectional movement of the tie rod are mounted on the ram.

3. The forging machine of claim 1 in which said means for effecting bidirectional movement of the tie rod comprise spring means arranged to bias the tie rod in the clamping direction, and powered release means arranged to counteract the spring means.

4. The forging machine of claim 1 in which said rotary adjustment drive means are mounted on the machine frame, and further comprising coupling means permitting relative axial movement between while transmitting rotary movement from the drive means to the tie rod.

5. The forging machine with four rams which are disposed in a cruciform manner in an operating plane and are movable radially to the longitudinal axis of the workpiece, and with forging tools connected to the rams by way of crosspieces which are adjustable transversely to the rams in the operating plane and which with the rams form a support, and the displacement of the crosspieces with respect to the rams being effected as a function of the setting of the end positions of the stroke of the rams such that the tools form a closed pass in the stroke inner end positions, by each tool being covered on its unused width of its operative surface by a lateral surface of one adjacent tool and by itself covering with one of its lateral surfaces the unused width of the operative surface of the other adjacent tool, the rams receiving in a longitudinal bore a shaft for adjusting the crosspiece and detachable clamping devices being provided for fixing the crosspieces relative to the rams, characterized in that each ram is traversed by a tie rod which is provided with inner and outer collars and which additionally traverses the crosspiece on the end face of the ram and a spring at the end of the ram remote from the crosspiece, and with the collars embraces the crosspiece with the spring and with mutual clamping of the ram and the crosspiece, a piston, which can be biased against the spring force in a cylinder connected to the ram and which then releases the clamping of the ram and the crosspiece, bears against the outer collar supporting the spring, and the tie rod is extended beyond the outer collar supporting the spring and is connected rotationally rigidly but axially displaceably to a rotary drive, supported on the machine frame by way of the cross member, for adjusting the stroke position.

6. A forging machine according to claim 5, characterized in that the inner collar which clamps the crosspiece against the ram is constructed as a lever arm which is provided with a pin parallel to the tie rod and a slide block mounted pivotally on the pin, and the crosspiece is provided with a guide slot which extends transversely to its direction of displacement and in which the slide block engages.

7. A forging machine according to claim 5, characterized in that the crosspiece is guided relative to the ram in the adjustment direction by guide blocks which in one part lie in grooves and guide the other part by grooves providing space for the adjustment of the crosspiece.

8. A forging machine according to claim 5 characterized in that respective inter-locking members lie in recesses in the end face of the ram and the crosspiece and are provided on their mutually opposite faces with fine toothing which mesh when the crosspiece is clamped against the ram.

9. A forging machine according to claim 5 characterized in that the spring is disposed in a spring cup, which can be mounted on the ram and can be connected to the ram, between spring plates and axial bearings supporting the latter, a cover for the spring cup being constructed as an annular cylinder in which is guided an annular piston which is operatively connected to the axial bearing which is associated with the spring plate connected to the outer collar of the tie rod.

10. A forging machine according to claim 5 characterized in that the outer end of the tie rod is provided with a multiply splined pin and engages in a multiply splined hub which is connected to a rotary drive by way of a coupling which compensates radial displacement.

11. A forging machine according to claim 10 characterized in that a gearwheel moved by two opposed plunger pistons by way of toothed racks is provided as the rotary drive.

12. A forging machine according to claim 1 characterized in that the ram is a cylinder guided axially movably in the machine frame and provided with a central shaft, a static annular piston is associated with the cylinder and is supported by way of a cross member which is adjustable with respect to the machine frame for adjusting the ram stroke position, the central shaft has a through bore for receiving the tie rod and the rotary drive for the tie rod is mounted in a bracket to the cross member.

13. A forging member according to claim 1 characterized in that the ram is a piston which is guided in the bore of a cylinder connected to the machine frame and which is provided with a shaft, a stopper, which surrounds the piston shaft and closes the cylinder bore, is supported by way of a cross member which is adjustable with respect to the machine frame for adjusting the ram stroke position, the piston shaft has a through bore for receiving the tie rod and the rotary drive for the tie rod is mounted in a bracket to the cross member.

14. A forging machine according to claim 1 characterized in that the ram is a piston guided in a cylinder and provided with a shaft passing through the cylinder base, the cylinder is supported so as to be adjustable in the machine frame for adjusting the ram stroke position, the piston shaft has a through bore for receiving the tie rod and the rotary drive for the tie rod is mounted in a bracket to the cross member.

15. A forging machine according to claim 1 characterized in that the ram comprises a central shaft, which is provided in the machine frame and is provided with an annular flange on which engage two or more piston-cylinder units which move the ram, the piston-cylinder units are supported by way of a cross member which is adjustable with respect to the machine frame for adjusting the ram stroke position, the piston shaft has a through bore for receiving the tie rod and the rotary drive for the tie rod is mounted in a bracket to the cross member.

* * * * *